US007566491B2

(12) United States Patent
Dilnik et al.

(10) Patent No.: US 7,566,491 B2
(45) Date of Patent: Jul. 28, 2009

(54) DISPOSABLE AND REUSABLE POUF PRODUCTS

(75) Inventors: Rebecca Lyn Dilnik, Neenah, WI (US); Dawn Lynn Ilnicki Houghton, Appleton, WI (US); Tammy Jo Balzar, Oshkosh, WI (US); Pamela Mary Thompson, Greenville, WI (US); Mary Rece Holt, Fremont, WI (US)

(73) Assignee: Kimberly Clark Worldwide, Inc., Appleton, WI (US)

( * ) Notice: Subject to any disclaimer, the term of this patent is extended or adjusted under 35 U.S.C. 154(b) by 1005 days.

(21) Appl. No.: 10/634,071

(22) Filed: Aug. 4, 2003

(65) Prior Publication Data

US 2005/0031833 A1 Feb. 10, 2005

(51) Int. Cl.
*B32B 3/00* (2006.01)

(52) U.S. Cl. ..... 428/316.6; 428/152; 206/77.1; 15/227; 15/118; 15/209.1

(58) Field of Classification Search ..... 15/227, 15/118, 209.1; 206/77.1; 428/152, 316.6
See application file for complete search history.

(56) References Cited

U.S. PATENT DOCUMENTS

| | | | | |
|---|---|---|---|---|
| 2,038,958 | A | 4/1936 | Reach | |
| 2,402,577 | A | 6/1946 | Rodgers | |
| 2,585,781 | A | 2/1952 | Johnson | |
| 2,648,085 | A | 8/1953 | Rodgers | |
| 2,666,223 | A | 1/1954 | Farrell | |
| 2,666,224 | A | 1/1954 | Adams | |
| 2,668,974 | A | 2/1954 | Jaeger | |
| 2,754,533 | A | 7/1956 | Swartout | |
| 2,755,497 | A | 7/1956 | Greacen, Jr. | |
| 2,816,311 | A | 12/1957 | Beck et al. | |
| 2,816,312 | A | 12/1957 | Beck et al. | |
| 2,849,821 | A | 9/1958 | Doig | |
| 2,908,930 | A | 10/1959 | Beck | |
| 2,996,744 | A | 8/1961 | Rodgers et al. | |
| 2,998,614 | A | 9/1961 | Winch | |
| 3,221,356 | A | 12/1965 | Schirmer | |
| 3,683,921 | A * | 8/1972 | Brooks et al. | 604/366 |
| 3,737,939 | A | 6/1973 | Jones, Sr. | |
| 3,777,759 | A | 12/1973 | Oehmke et al. | |
| 3,922,407 | A | 11/1975 | Nimmo, Jr. et al. | |

(Continued)

FOREIGN PATENT DOCUMENTS

EP 0 313 495 A1 4/1989

(Continued)

OTHER PUBLICATIONS

"Frank's Super Bow," a copy of the packaging of a bow sold prior to the application date of the current application.

*Primary Examiner*—Michael C Miggins
(74) *Attorney, Agent, or Firm*—Alyssa A. Dudkowski

(57) ABSTRACT

The present invention is a poufable product that is capable of being converted into a pouf product. The poufable product is comprised of at least one flat ply of flexible sheet material having at least one side edge and at least one cord. The cord engages at least one ply of the flexible sheet material such that the flexible sheet material is capable of bunching on or about the cord.

15 Claims, 6 Drawing Sheets

U.S. PATENT DOCUMENTS

| | | | | | |
|---|---|---|---|---|---|
| 3,948,390 | A | * | 4/1976 | Ferreri | 206/370 |
| 4,034,443 | A | | 7/1977 | Turner | |
| 4,108,180 | A | * | 8/1978 | Moehrle | 604/369 |
| 4,112,551 | A | | 9/1978 | Sales | |
| 4,428,375 | A | * | 1/1984 | Ellman | 606/151 |
| 4,457,038 | A | | 7/1984 | Hammond | |
| 4,462,135 | A | | 7/1984 | Sanford | |
| 4,466,152 | A | | 8/1984 | Moss et al. | |
| 4,493,124 | A | | 1/1985 | Agapiou | |
| 4,585,676 | A | | 4/1986 | Desmet et al. | |
| 4,642,836 | A | | 2/1987 | Bokmiller | |
| 4,834,733 | A | | 5/1989 | Huntoon et al. | |
| 4,852,201 | A | | 8/1989 | Wundrock et al. | |
| 4,932,095 | A | | 6/1990 | Kawase | |
| 5,090,832 | A | | 2/1992 | Rivera et al. | |
| 5,094,559 | A | | 3/1992 | Rivera et al. | |
| 5,144,744 | A | | 9/1992 | Campagnoli | |
| 5,397,625 | A | | 3/1995 | Osteen et al. | |
| 5,403,642 | A | | 4/1995 | Landi et al. | |
| 5,412,830 | A | | 5/1995 | Girardot et al. | |
| 5,415,643 | A | | 5/1995 | Kolb | |
| 5,465,452 | A | | 11/1995 | Girardot et al. | |
| 5,471,697 | A | | 12/1995 | Daconta | |
| 5,509,913 | A | | 4/1996 | Yeo | |
| 5,525,393 | A | | 6/1996 | Raab | |
| 5,623,888 | A | | 4/1997 | Zafiroglu | |
| 5,630,243 | A | | 5/1997 | Federico et al. | |
| 5,738,646 | A | | 4/1998 | Fox et al. | |
| 5,813,523 | A | * | 9/1998 | Gnadt et al. | 206/77.1 |
| 5,888,002 | A | | 3/1999 | Fenstersheib | |
| 5,916,969 | A | | 6/1999 | Wang et al. | |
| 5,946,780 | A | | 9/1999 | Borcherds et al. | |
| 6,007,750 | A | * | 12/1999 | Firgo et al. | 264/54 |
| 6,295,688 | B1 | | 10/2001 | Sayles et al. | |
| 6,322,801 | B1 | | 11/2001 | Lorenzi et al. | |
| 6,326,339 | B1 | | 12/2001 | Rattinger et al. | |
| 6,383,161 | B1 | | 5/2002 | Balzar et al. | |
| 6,423,883 | B1 | | 7/2002 | Morman et al. | |
| 6,463,620 | B2 | | 10/2002 | Busha | |
| 6,485,822 | B1 | * | 11/2002 | Osiecki et al. | 428/316.6 |
| 6,607,739 | B1 | * | 8/2003 | Wallo | 424/404 |
| 2002/0014273 | A1 | * | 2/2002 | Masterson | 139/385 |
| 2002/0152571 | A1 | | 10/2002 | Lee | |
| 2003/0014824 | A1 | * | 1/2003 | Farmer | 15/118 |

FOREIGN PATENT DOCUMENTS

| | | | | |
|---|---|---|---|---|
| EP | 0 709 053 | A1 | | 5/1996 |
| EP | 1 125 540 | A1 | | 8/2001 |
| EP | 1 183 980 | A2 | | 3/2002 |
| EP | 1 190 657 | A1 | | 3/2002 |
| FR | 2 530 940 | A1 | | 2/1984 |
| JP | 06344479 | A | * | 12/1994 |
| JP | 10192188 | A | * | 7/1998 |
| JP | 2001-046279 | A | | 2/2001 |
| WO | WO 95/00116 | A2 | | 1/1995 |
| WO | WO 99/09873 | A1 | | 3/1999 |
| WO | WO 00/71012 | A1 | | 11/2000 |
| WO | WO 01/43618 | A1 | | 6/2001 |
| WO | WO 02/071907 | A1 | | 9/2002 |

* cited by examiner

DISPOSABLE AND REUSABLE POUF PRODUCTS

Netted or meshed bathing poufs are popular bathing devices that may be used in place of or in conjunction with wash clothes during a shower or bath. Bathing poufs may be used with liquid or bar soap to create lather during bathing, thereby providing mechanical cleansing and exfoliation benefits not provided by the soap alone or in combination with a terry washcloth or natural or synthetic sponge. Moisturizing compositions or soaps containing such compositions are frequently applied using bathing poufs. Such bathing poufs may also be used without soap, thereby providing mechanical scrubbing and exfoliation benefits.

After use, a bathing pouf requires special handling to restore the pouf to a clean healthy condition for the next use especially if shared between individuals, such as within a family. If the bathing poufs are not properly cleaned, mildew tends to form on the netted material and/or cord which may function as a handle as well as a device to maintain the gathered configuration of the netted material, especially toward the center or gathered portion of the bathing poufs where the netted material tends to be more concentrated, thus more easily retaining or trapping water, soap, and other matter and substances that the bathing poufs encounter during use as well as a possible source of unpleasant odors. This problem may be exacerbated if the netted material and/or cord are made of absorbent material. Such matter which can be retained or trapped in the bathing poufs include hair, dirt, dead skin cells, fecal material and other bodily waste, and germs, such as viruses, bacteria, molds, mildews, and fungi. In addition, bathing poufs are difficult to dry, presenting problems with storage between uses and during travel as well as generation of unpleasant odors. Where and how the bathing pouf is stored or comes into contact with between uses, such as a location that encourages growth of mildew, molds, viruses, and bacteria or provides additional exposure to such mildew, molds, viruses, and bacteria or materials to support such growth, further contaminates the bathing pouf.

However, cleaning such bathing poufs after use can prove to be very difficult at best. When bathing poufs are cleaned, the poufs tend to rip or fall apart. Any chemicals used to clean and sanitize the bathing poufs can be retained or trapped in the poufs as well, raising concerns with future use of the bathing poufs in which such chemicals may seep out during use and come into contact with the skin, hair, and eyes of the user. In addition, such chemicals used to clean the bathing poufs may also damage or otherwise affect the structure, such as causing the netted material to become brittle, or appearance of the bathing poufs. If the bathing poufs are cleaned using a washer and dryer, the mechanical action of the washer and dryer and/or the heat of the dryer may damage the bathing pouf. Therefore, most bathing poufs are never cleaned though the bathing poufs are used for months or even years. The costs of bathing poufs also contribute to the consumers reluctance to use chemicals to clean the bathing poufs or to replace compromised bathing poufs.

Due to the configuration of the bathing poufs, it is very difficult to determine if the bath poufs have been adequately cleaned. It is often impossible to determine that the bathing poufs have not been adequately cleaned until the growth of mildew and molds are detected. Once the growth of mildew and molds have been detected, it is very difficult, if not impossible, to clean the bathing poufs to eliminate the mildew and molds.

Accordingly, there is a need for a pourable product that provides both sufficient lathering and exfoliating capabilities for users as well as ease of cleansing and storage of the pourable product between uses. There is a need for a disposable pourable product that provides sufficient lathering and exfoliating capabilities for users at an affordable cost. It is understood that disposable pourable product is not limited to a single use or limited use pourable product but also refers to pourable products that are so inexpensive to the consumer that the pourable product may be discarded if the pourable product become soiled or otherwise unusable after only one or a few uses, such as up to about 10 to about 20 uses. There is also a need to provide a fresh or clean pourable product for each use, such as a cleaning task (i.e., scrubbing dishes after each meal) or every shower.

SUMMARY OF THE INVENTION

The present invention is a pourable product capable of being converted into a pouf product. The pourable product is comprised of at least one flat ply of flexible sheet material having at least one side edge and at least one cord. The cord is interlaced through at least one ply of the flexible sheet material such that the flexible sheet material is capable of bunching on or about the cord. The consumer bunches or gathers the flexible sheet material about the cord, thereby providing a pouf product.

Another embodiment of the present invention is a pourable product capable of being converted into a pouf product. The pourable product is comprised of at least one flat ply of flexible sheet material having opposing side edges and opposing end edges and at least one cord. The cord is interlaced through at least one ply of the flexible sheet material such that the flexible sheet material is capable of bunching on or about the cord. The consumer may bunch or gather the flexible sheet material about the cord, thereby providing a pouf product.

The present invention also includes a method of using a pourable product which is capable of being converted into a pouf product. The method comprises providing at least one flat ply of flexible sheet material having at least one side edge and at least one cord wherein the cord is interlaced through at least one ply of the flexible sheet material such that the flexible sheet material is capable of bunching about the cord and engaging the cord, causing the flexible sheet material to bunch about the cord. The cord may be disengaged, causing the flexible sheet material to unbunch or ungather about the cord such that the pouf product is returned to a pourable product. A mitt structure may also be provided. A handle capable of being engaged with the mitt structure may also be provided.

DETAILED DESCRIPTION OF THE INVENTION

Figure 1:
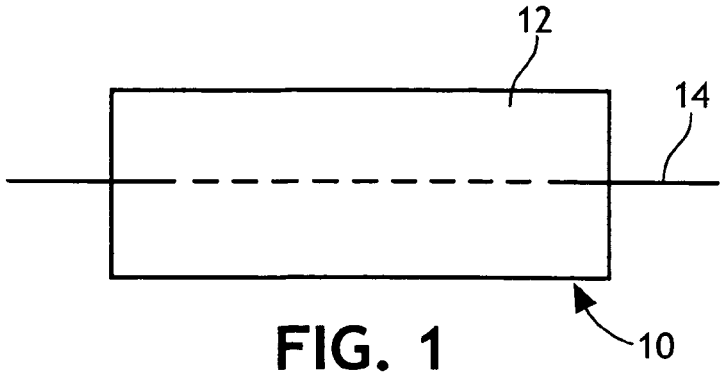
FIG. 1 is a perspective representation of the pourable product of the present invention.

As shown in FIG. 1, one embodiment of the present invention is a pourable product 10 which may be provided or stored in a flat configuration. The flat configuration of the pourable product 10 provides a more convenient form for shipping the pourable product 10 to retail outlets as well as shelving and displaying at the retail outlets. In addition, the flat configuration provides more convenient storage of the pourable products 10 before and between uses for consumers. The flat configuration of the pourable product 10 also provides a more convenient form for traveling, requiring less space in luggage or toiletry cases. In addition, the pourable products 10 may be returned to the flat configuration after use to facilitate the cleaning and drying of the pourable products 10. The pourable products 10 may be provided to the retail outlets or consumers individually or in multi-unit packaging. The pourable products 10 may or may not be individually wrapped within a multi-unit package.

Figure 1A:
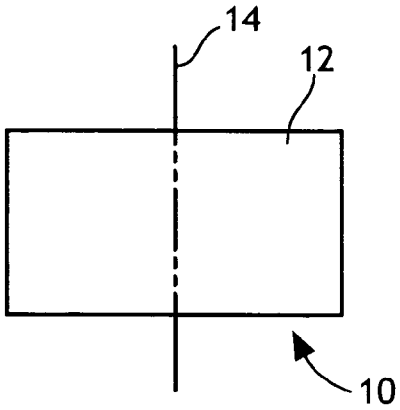
FIG. 1*a* is a perspective representation of the pourable product of the present invention.
Figure 1B:
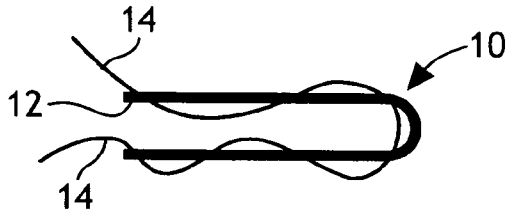
FIG. 1*b* is a perspective representation of the pourable product of the present invention.

The pourable product 10 may be disposable or reusable. The term 'disposable pourable product' as used herein includes pourable products, when converted to pouf products 15, which are typically disposed of after 1 to 10 uses. The pourable product 10 is comprised of a flexible sheet material 12 and a cord 14. The cord 14 is interlaced through the flexible sheet material 12 at least two points such that the flexible sheet material 12 may be bunched on or about the cord 14. In another embodiment of the present invention, multiple pourable products char 10 may be assembled on or about the cord 14. FIGS. 1*a* and 1*b* show other embodiments of pourable products 10 of the present invention.

Figure 2:
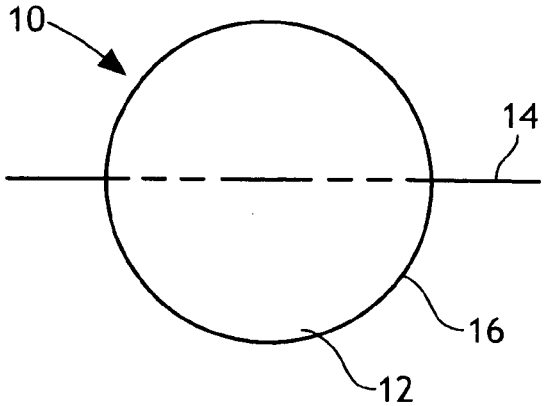
FIG. 2 is another perspective representation of the pourable product of the present invention.
Figure 3:
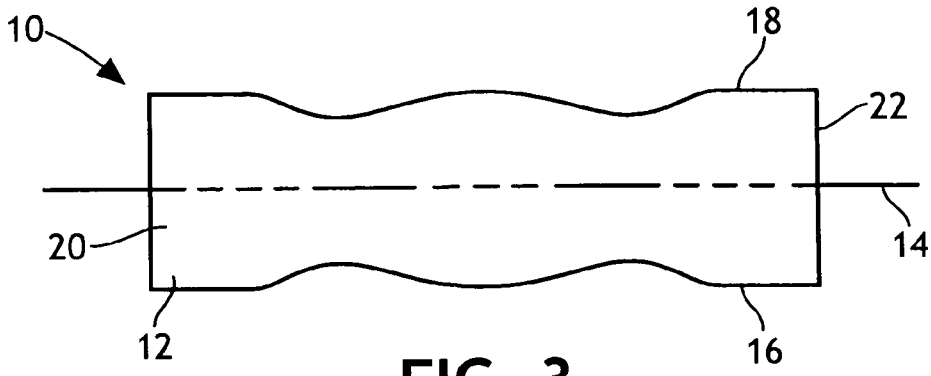
FIG. 3 is another perspective representation of the pourable product of the present invention.
Figure 6:
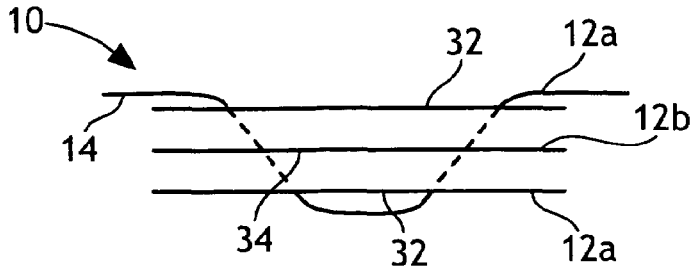
FIG. 6 is a cross sectional view of the pourable product of the present invention showing three plies of flexible sheet material.
Figure 6A:
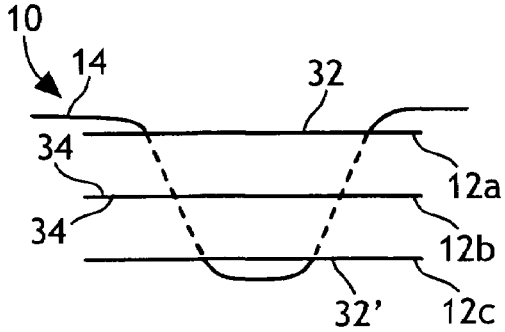
FIG. 6*a* is a cross sectional view of the pourable product of the present invention showing three plies of flexible sheet material.

The flexible sheet material 12 may be one ply or may be multiple plies. An example of multi-ply flexible sheet material 12 is shown in FIG. 6. The flexible sheet material 12 may be one layer or may be multi-layer. The flexible sheet material 12 may comprise any combination of single layer, multi-layer, single ply, or multiplies. As used herein, the term "layer" refers to a single thickness, course, or stratum of the flexible sheet material 12 that may lay over or under another. An example of a multi-layer flexible sheet material 12 is shown in FIG. 6*a*. The flexible sheet material 12 includes at least one side edge 16 (see FIG. 2). In other embodiments of the present invention, the flexible sheet material 12 may include opposing side edges 16 and 18 and opposing end edges 20 and 22 (see FIG. 3). The flexible sheet material 12 may also be a tubular material that is utilized in a pourable product 10.

Figure 7:
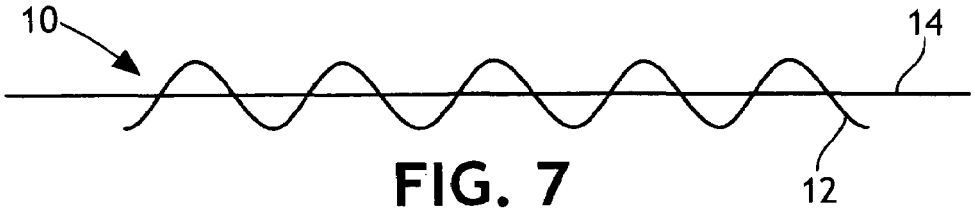
FIG. 7 is a cross sectional view of the pourable product of the present invention showing one ply of flexible sheet material.
Figure 8:
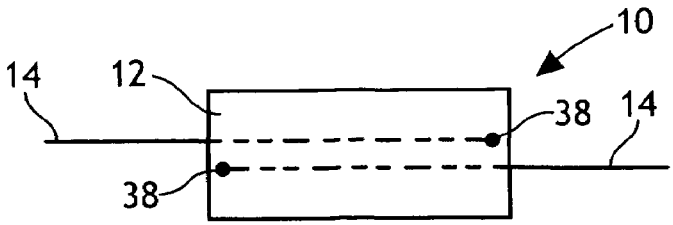
FIG. 8 is another perspective representation of the pourable product of the present invention.

The cord 14 may be interlaced through the flexible sheet material 12, within the side edge 16, between the opposing side edges 16 and 18, or between the opposing end edges 20 and 22. The cord 14 may be interlaced through the flexible sheet material 12 such that the cord 14 is parallel to at least a portion of the opposing side edges 16 and 18, alternatively parallel to at least a portion of the opposing end edge 20 and 22, or, alternatively, adjacent at least a portion of the side edge 16, at least a portion of one of the opposing side edges 16 or 18, or one of the opposing end edges 20 or 22 (see FIG. 2 or 3). The cord 14 may be interlaced with the flexible sheet material 12 in evenly spaced configuration, or in an uneven configuration. The cord 14 may be interlaced such that the flexible sheet material 12 forms an accordion pleated-like structure when gathered on the cord 14 as shown in FIG. 7. In addition, the cord 14 may or may not be affixed to the flexible sheet material 12 at one end or along a portion of the cord 14 as shown in FIGS. 7 and 8 at numeral 38.

Figure 4:
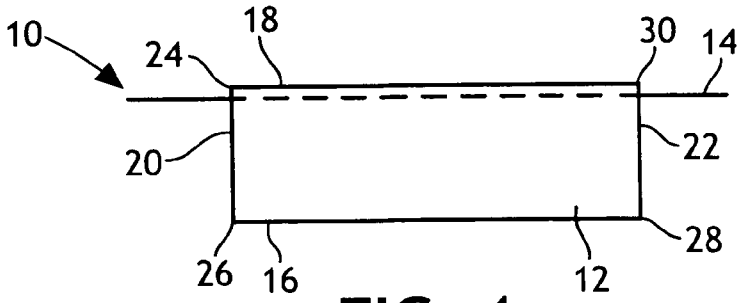
FIG. 4 is another perspective representation of the pourable product of the present invention.
Figure 5:
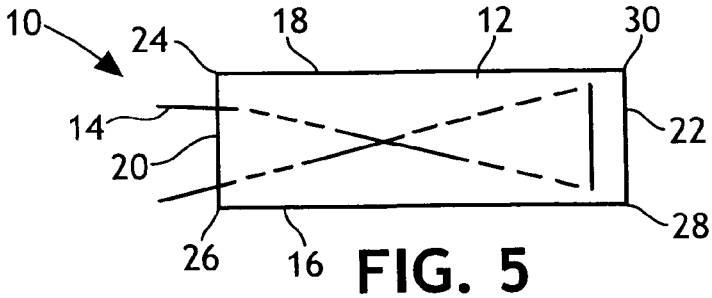
FIG. 5 is another perspective representation of the pourable product of the present invention.
Figure 5A:
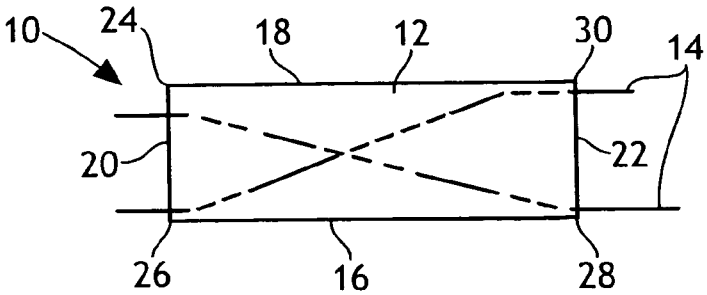
FIG. 5*a* is another perspective representation of the pourable product of the present invention.
Figure 5B:
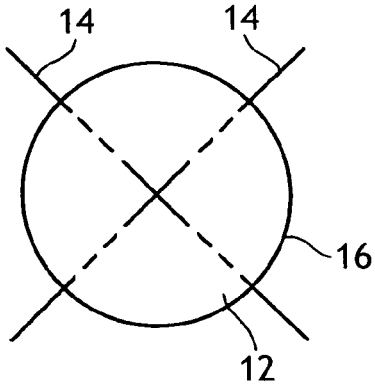
FIG. 5*b* is another perspective representation of the pourable product of the present invention.

In addition, the cord 14 may be interlaced through the flexible sheet material 12 such that the cord 14 interacts with at least two of the corners 24, 26, 28, or 30 of the flexible sheet material 12 (see FIG. 4). In another embodiment of the present invention, the cord 14 may be interlaced through the flexible sheet material 12 such that an 'X' configuration is formed by the cord 14 (see FIG. 5). The 'X' configuration may also be formed by using two cords 14 as shown in FIGS. 5*a*, and 5*b*.

The shape of the flexible sheet material 12 may be a square, rectangle, triangle, circle, oval, irregular or asymmetrical, or any shape suitable for use in the pourable product 10 of the present invention. Such shapes may include multi-lobed shapes like 'dog-bone' or 'flower' shapes. (See FIGS. 3 and 17).

The flexible sheet material 12 may be comprised of any material or materials that would be compatible with the water, soaps, chemicals, substances, and matter that the pourable product 10, or pouf product 15, would encounter during use. The flexible sheet material 12 may be absorbent or non-absorbent. The flexible sheet material 12 may be elastic, nonelastic, or a combination thereof. The flexible sheet material 12 may be hydrophobic or hydrophilic. The pourable product 10 may be prepared from readily available raw materials or with specially designed materials having at least one aperture for receiving the cord 14, including porous film, knitted, woven, nonwoven, netted, spunbond, airlaid, spunlace, double recreped, hydroentangled staple fibers, meshed, braided, entangled materials, hereinafter referred to as flexible sheet material 12. The flexible sheet material 12 may have a smooth texture or a three dimensional texture. The flexible sheet material 12 may be comprised of dispersible, compostible, heat activated, and/or fluid activated shrinkable material that causes the flexible sheet material 12 to bunch on or about the cord 14 or about itself once the shrinkable material has been activated.

Some examples of such materials are disclosed in U.S. Pat. Nos. 6,423,883 B1; 6,383,161 B1; 5,509,913; 4,834,733; 5,916,969; 5,738,646; and, 5,397,625. The flexible sheet material 12 may be comprised of a natural material, a synthetic material, or a combination of natural and synthetic materials. The flexible sheet material 12 may comprise cotton, linen, wool, nylon, polyester, spandex, cellulosic materials, rayon, polyethylene, polypropylene, polyethylene-terphthalate, acrylic acids, polylactides, polyacrylamides, polypropylene oxides, polyethylene oxides, polyvinyl alcohols, polyvinyl oxides, polyvinyl pyrolidones, polyacrylates, polypeptides, polysaccharides, polyvinyl acetates, ethylene vinyl acetates, or combinations or blends of any of these materials. It is understood that the terms "combination" or "combinations" as used herein includes combination(s) and/or blend(s).

It is understood that the term "aperature" as used herein means an opening or open space in the flexible sheet material 12. It may represent an opening cut into or formed in the flexible sheet material 12. It may also represent an open space between the givers, threads, or strands comprising the flexible sheet material 12. It is also understood that the term "aperature" may be a loop-like structure. The loop-like aperature may be within or outside the plane of the surface of the flexible sheet material 12.

As stated above, the flexible sheet material 12 may be made of or comprise natural or synthetic materials. The polymeric flexible sheet material 12 may be prepared from extruded from strong and flexible polymeric material, such as polyethylene. The polymeric flexible sheet material 12 may also consist of addition polymers of olefin monomers, and polyamides of polycarboxylic acids and polyamines. The polymeric flexible sheet material 12 can be extruded as strips or in tubular structures.

The flexible sheet material 12 may be biodegradable, flushable, dispersible, or a combination thereof. One example is polylactic acid based material. Other examples of such materials are disclosed in U.S. Pat. Nos. 6,423,883 B1; 6,383,161 B1; 5,509,913; 4,834,733; 5,916,969; 5,738,646; and, 5,397,625. The flexible sheet material 12 may or may not be permeable to fluids. The flexible sheet material 12 may or may not be breathable. It is understood that the flexible sheet material 12 may be breathable and impermeable; breathable and permeable; or, not breathable and impermeable.

The flexible sheet material 12 may be treated with any chemical treatment that would provide a further benefit to the consumer, including but not limited to, soap compositions, such as soaps and shower gels; lotion compositions; antimicrobial compositions, anti-fungal compositions, and antiviral compositions; cleanser compositions, such as compositions for cleaning counters, floors, toilets, dishes, and the like; and, combinations thereof. A pourable product 10 may be treated such that the chemical treatment is released during use, such as would be desired with a shower gel or lotion composition. In the alternative, the pourable product 10 may be treated such that the chemical treatment is retained within or on the pourable product 10 during use, such as an antifungal composition to inhibit growth of molds, mildews, fungus and the like between uses.

The length of the flexible sheet material 12 for use in the pourable product 10 of the present invention may be any length that would provide a product that is effective for the purpose intended. In some embodiments of the present invention, the length of the flexible sheet material 12 for use in the pourable product 10 may range between from about 6 inches to about 12 feet, more specifically about 2 feet to about 12 feet, more specifically between from about 3 feet to about 11 feet, more specifically between from about 3 feet to about 10 feet, more specifically between about 4 feet to about 10 feet, more specifically between about 4 feet to about 9 feet, more specifically between about 5 feet to about 9 feet, more specifically between about 5 feet to about 8 feet, more specifically from about 6 feet to about 8 feet, and most specifically about 7 feet. In another embodiment of the present invention, the length of the flexible sheet material 12 may range between from about 6 inches to about 3 feet, more specifically between from about 9 inches to about 2½ feet, and most specifically between from about 1 foot to about 2 feet. In accordance with still another embodiment of the present invention, the length of the flexible sheet material 12 may range between from about 2 feet to about 5 feet, more specifically between from about 2½ feet to about 4½ feet, and most specifically between from about 3 feet to about 4 feet. In another embodiment of the present invention, the length of the flexible sheet material 12 may range between from about 1 foot to about 5 feet, more specifically between from about 2 feet to about 3 feet, and most specifically about 2½ feet.

The width of the flexible sheet material 12 for use in the pourable product 10 of the present invention may be any width that would provide a product that is effective for the purpose intended. In some embodiments of the present invention, the width of the flexible sheet material 12 for use in the pourable product 10 may range between from about ¼ inch to about 3 feet, more specifically about ½ inch to about 3 feet, more specifically between from about 1 inch to about 3 feet, more specifically between from about 2 inches to about 3 feet, more specifically between about 3 inches to about 3 feet, more specifically between about 4 inches to about 3 feet, more specifically between about 5 inches to about 3 feet, more specifically between about 6 inches to about 3 feet, more specifically from about 6 inches to about 2½ feet, more specifically from about 6 inches to about 2 feet, more specifically from about 6 inches to about 1½ feet and most specifically about 1 foot. In another embodiment of the present invention, the width of the flexible sheet material 12 may range between from about ¼ inch to about 1 foot, more specifically from about ½ inch to about 1 foot, more specifically from about 1 inch to about 1 foot, more specifically from about 1 inch to about 10 inches, more specifically from about 2 inches to about 10 inches, more specifically from about 2 inches to about 9 inches, more specifically from about 3 inches to about 8 inches, more specifically from about 4 inches to about 8 inches, more specifically from about 5 inches to about 8 inches, more specifically between from about 5 inches to about 7 inches, and most specifically about 6 inches. In accordance with still another embodiment of the present invention, the width of the flexible sheet material 12 may range between from about 2 inches to about 1½ feet, more specifically between from about 3 inches to about 1½ feet, more specifically between from about 4 inches to about 1½ feet, more specifically between from about 4 inches to about 16 inches, more specifically between from about 6 inches to about 16 inches, more specifically from about 6 inches to about 14 inches, more specifically from about 8 inches to about 14 inches, more specifically between from about 8 inches to about 12 inches, more specifically between about 8 inches to about 10 inches, and most specifically about 8 inches. In another embodiment of the present invention, the width of the flexible sheet material 12 may range between from about 1 foot to about 5 feet, more specifically between from about 2 feet to about 3 feet, and most specifically about 2½ feet.

The filament or fiber size of the flexible sheet material 12 may be between about 0.1 denier to about 10 denier, more specifically between about 0.3 denier to about 7 denier, and most specifically between about 0.5 denier to about 3 denier. It is understood that when referring to filament size, such reference is to filament or fiber size.

Figure 1C:
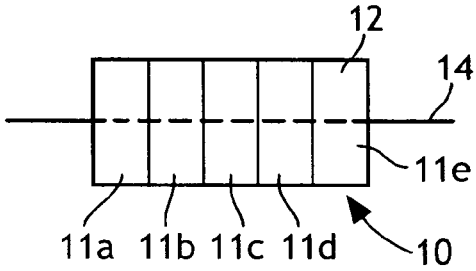
FIG. 1*c* is a perspective representation of the pourable product of the present invention.
Figure 1D:
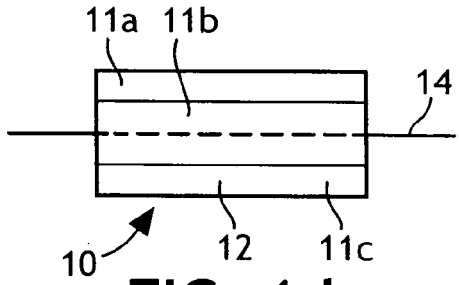
FIG. 1*d* is a perspective representation of the pourable product of the present invention.
Figure 1E:
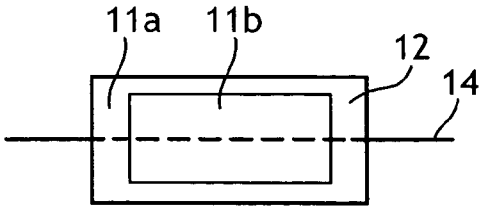
FIG. 1*e* is a perspective representation of the pourable product of the present invention.

In some embodiments of the present invention, the flexible sheet material 12 may comprise 2 or more areas or regions which provide different characteristics or properties, such as softness, coarseness, lathering, exfoliation, texture, stiffness, materials structure, absorbency, mesh size, filament or fiber size, color, composition, resilience, dispersability, porosity, benefit agent, and the like. These areas or regions providing different characteristics or properties of the flexible sheet material 12 may be incorporated into the flexible sheet material 12 by mechanical, chemical, or other treatments or by incorporation of different materials into the areas or regions of the flexible sheet material 12 where such provided characteristics or properties are desired. In other embodiments of the present invention, the flexible sheet material 12 may comprise two or more different materials attached together to provide the areas or regions having different characteristics or properties. These materials forming the areas or regions may be attached by any means known in the art, including, but not limited to, adhesives, sewing, thermal or ultrasonic bonding, hook and loop, hook and eye, snaps, and buttons. Examples of such areas or regions are shown in FIGS. 1*c,* 1*d,* and 1*e.* Elements 11*a,* 11*b,* 11*c,* 11*d,* and 11*e* represent the areas or regions of the flexible sheet material 12 providing the different characteristics or properties. In other embodiments of the present invention, one or more plies, such as 12*a* or 12*b,* and/or one or more layers, such as 13*a* or 13*b,* of a pourable product 10 may also comprise areas or regions, such as 11*a,* 11*b,* 11*c,* 11*d,* and 11*e.*

One or more plies of the flexible sheet material 12 may be employed in the construction of the pourable product 10. By employing at least two plies 12*a* and 12*b* of the flexible sheet material 12, each ply 12*a* or 12*b* may be comprised of a same or different flexible sheet material 12, thereby providing a pourable product 10 with improved or different characteristics or properties. For example, shown in FIG. 6, the ply 12*a* comprising a softer flexible sheet material 12 may be positioned as the body contacting surface 32 of the pourable product 10 while the ply 12*b* comprising a coarser or stiffer flexible sheet material 12 may be used as a non-body contacting surface 34 such that the ply 12*b* comprising the stiffer flexible sheet material 12 provides better lathering characteristics or properties for the pourable product 10, or ultimately, the pouf product 15 while the ply 12*a* comprising the softer flexible sheet material 12*a* provides a more gentle scrubbing surface. Another example is using one ply 12*a* of a flexible sheet material 12 having one color and another ply 12*b* of a flexible sheet material 12 having a different color in the pourable product 10.

The plies 12*a* and 12*b* of the flexible sheet materials 12 used in the pourable product 10 of the present invention may also differ in other characteristics or properties such as texture, stiffness, material structure, absorbency, mesh size, filament or fiber size, color, composition, resilience, dispersability, porosity, benefit agent, and the like.

In another embodiment of the present invention, the pourable product 10 may comprise at least three plies 12*a*, 12*b*, and 12*c* of the flexible sheet material 12, each ply 12*a*, 12*b*, and 12*c* may be comprised of a same or different flexible sheet material 12, thereby providing a pourable product 10 with improved or different characteristics or properties. For example, shown in FIG. 6*a,* the ply 12*a* comprising a softer flexible sheet material 12 may be positioned as the body contacting surface 32 of the pourable product 10. The ply 12*c* comprising a coarser or stiffer flexible sheet material 12 may be used as a body contacting surface 32' such that the ply 12*c* comprising the stiffer flexible sheet material 12 provides better lathering characteristics or properties for the pourable product 10, or ultimately, the pouf product 15 while the ply 12*a* comprising the softer flexible sheet material 12*a* provides a more gentle scrubbing surface. The ply 12*b* of flexible sheet material 12 comprising a benefit agent, such as a benefit agent is released from the ply 12*b*—such as soap or lotion—may be used as a non-body contacting surface 34 such that the ply 12*b* of the flexible sheet material 12 provides a benefit property for the pourable product 10, or ultimately, the pouf product 15. Another example is using one ply 12*a* of a flexible sheet material 12 having one color and another ply 12*b* of a flexible sheet material 12 having a different color in the pourable product 10.

The plies 12*a*, 12*b*, and 12*c* of the flexible sheet materials 12 used in the pourable product 10 of the present invention may also differ in other characteristics or properties such as texture, stiffness, material structure, absorbency, mesh size, filament or fiber size, color, composition, resilience, dispersability, porosity; benefit agent, and the like.

Figure 6B:
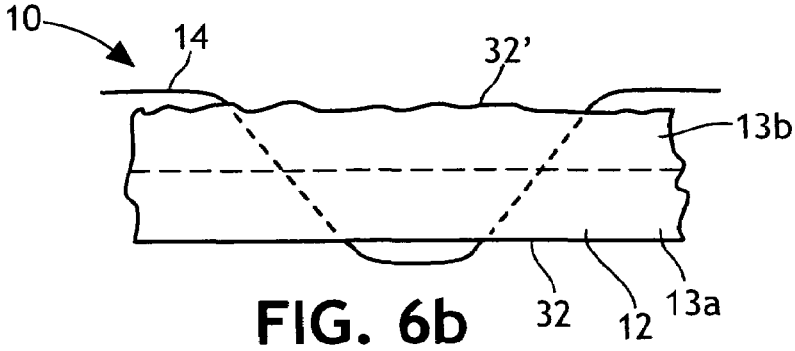
FIG. 6*b* is a cross sectional view of the pourable product of the present invention showing two layers of flexible sheet material.

In other embodiments of the present invention, one or more layers of the flexible sheet material 12 may be employed in the construction of the pourable product 10. By employing at least two layers 13*a* and 13*b* of the flexible sheet material 12, each layer 13*a* and 13*b* may be comprised of a different material or material having a different property, such as texture, stiffness, material structure, absorbency, mesh size, filament or fiber size, color, composition, resilience, dispersability, porosity, benefit agent, and the like, thereby providing a pourable product 10 with improved characteristics. For example, shown in FIG. 6*b*, a layer 13*a* of a softer flexible sheet material 12 may be positioned as the body contacting surface 32 of the pourable product 10 while a layer 13*b* of a coarser or stiffer flexible sheet material 12 may be used as a body contacting surface 32' such that the layer 13*b* of the stiffer flexible sheet material 12 provides better lathering characteristics or properties for the pourable product 10, or ultimately, the pouf product 15 while the layer 13*a* of the softer flexible sheet material 12*a* provides a more gentle scrubbing surface. Another example is using one layer 13*a* of a flexible sheet material 12 having one color and another layer 13*b* of a flexible sheet material 12 having a different color in the pourable product 10.

The layers 13*a* and 13*b* of the flexible sheet materials 12 used in the pourable product 10 of the present invention may also differ other characteristics or properties such as in material structure, absorbency, mesh size, filament or fiber size, color, composition, resilience, dispersabiity, and the like. It is understood that the pourable product 10 may be constructed incorporating any combination of layers and plies of flexible sheet material 12 as discussed above.

Figure 17:
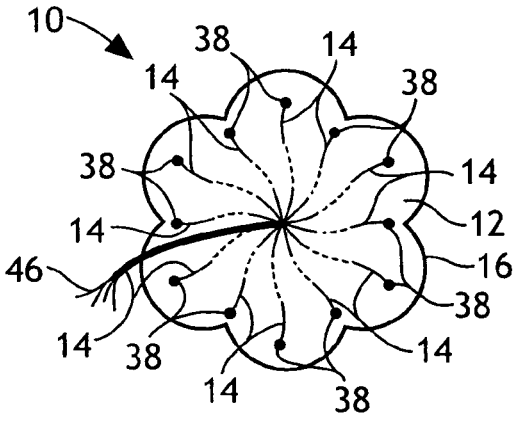
FIG. 17 is another perspective representation of the pourable product of the present invention.

The cord 14 may be comprised of a natural material, a syntetic material, or a combination of natural and synthetic materials. The cord 14 may comprise cotton, linen, wool, nylon, polyester, spandex, cellulosic materials, rayon, polyethylene, polypropylene, polyethylene-terphthalate, acrylic acids, polylactides, polyacrylamides, polypropylene oxides, polyethylene oxides, polyvinyl alcohols, polyvinyl oxides, polyvinyl pyrolidones, polyacrylates, polypeptides, polysaccharides, polyvinyl acetates, ethylene vinyl acetates, or combinations or blends of any of these materials. It is understood that the terms "combination" or "combinations" as used herein includes combination(s) and/or blend(s). In addition, the cord 14 may be made of or comprise any of the materials that could be used to make the flexible sheet material 12. The cord 14 may be elastic or non-elastic or combinations thereof. The cord 14 may comprise porous film, knitted, woven, nonwoven, netted, spunbond, airlaid, spunlace, double recreped, hydroentangled staple fibers, meshed, braided, entangled materials. The cord 14 may be comprised of dispersible, compostible, heat activated, and/or fluid activated shrinkable material that causes the flexible sheet material 12 to bunch on or about the cord 14 or about itself once the shrinkable material has been activated. Some examples of such materials are disclosed in U.S. Pat. Nos. 6,423,883 B1; 4,834,733; and, 5,397,625. The cord 14 may have a smooth texture or a three dimensional texture. More specifically, the cord 14 may be made of any hydrophobic or hydrophilic rope-like or strand-like material. The cord 14 may be absorbent or non-absorbent. It is understood that the cord 14 may be biodegradable, flushable, dispersible, or a combination thereof. One example is polylactic acid based material. Other examples of such materials are disclosed in U.S. Pat. Nos. 6,383,161 B1; 5,916,969; 5,738,646; and, 5,509,913. The cord 14 may be single stranded or multi-stranded. The multi-stranded cord 14 may be twisted, woven, nonwoven, knitted, braided, entangled, extruded, or simply two or more adjacent single strands. The cross-section of the cord 14 may be any shape, including, but not limited to round, oval, rectangular, square, triangular, regularly shaped, irregular shaped, symmetrically shaped, asymmetrical shaped, and the like. The cord 14 may be ribbon-like or may be rope-like. The cord 14 may be utilized as a non-looped structure (having free ends) or as a looped structure (the ends being tied together, fused together, or otherwise brought together to form a continuous loop as shown in FIG. 17).

The cord 14 may also be used as a handle or as a handling means. It is contemplated that more than one cord 14 may be utilized in the present invention in place of a single cord 14. (See FIGS. 5*a*, 5*b*, 8, 9, and 16). As used herein, the term 'cord' is understood to include one or more cords 14.

The width of the cord 14 for use in the pourable product 10 of the present invention ranges between from about 0.1 inch to about 10 inches, more specifically between from about 0.1 inch to about 9 inches, more specifically between from about 0.1 inch to about 8 inches, more specifically between from about 0.1 inch to about 7 inches, more specifically between from about 0.1 inch to about 6 inches, more specifically between from about 0.2 inch to about 6 inches, more specifically between from about 0.2 inch to about 5 inches, more specifically between from about 0.2 inch to about 4 inches, more specifically between from about 0.2 inch to about 3 inches, more specifically between from about 0.2 inch to about 2 inches, and most specifically between from about 0.2 inch to about 0.1 inch. In some embodiments, the width of the cord 14 may range between about 0.1 to about 1 inch, more specifically between from about 0.2 inch to about 0.5 inch, and most specifically between from about 0.3 inch to about 0.4 inch. In other embodiments, the width of the cord 14 may range between about 0.01 to about 1 inch, more specifically between from about 0.01 inch to about 0.75 inch, more specifically between from about 0.02 inch to about 0.75 inch, more specifically between from about 0.02 inch to about 0.5 inch, more specifically between from about 0.03 inch to about 0.5 inch, more specifically between from about 0.03 inch to about 0.4 inch, more specifically between from about 0.05 inch to about 0.4 inch, more specifically between from about 0.05 inch to about 0.3 inch, and most specifically between from about 0.07 inch to about 0.4 inch.

The overall length of the cord 14 may vary depending on the embodiment of the pourable product 10 into which the cord 14 is incorporated. In some embodiments of the present invention, the cord 14 may extend beyond the flexible sheet material 12 while the flexible sheet material 12 is in a flat configuration. In other embodiments of the present invention, the cord 14 may not extend beyond the flexible sheet material 12. The cord 14 may be longer or shorter than the length of the flexible sheet material 12 in a flat configuration.

In some embodiments of the present invention, the length of the cord 14 may range from between about 0.1 to about 4 times the length of the flexible sheet material 12, more specifically between from about 0.2 to about 3 times the length of the flexible sheet material 12, and most specifically between from about 0.5 to about 2 times the length of the flexible sheet material 12. In other embodiments, the cord 14 may range from between about 0.5 to about 3 times the length of the flexible sheet material 12, more specifically between from about 0.5 to about 2 times the length of the flexible sheet material 12, more specifically between from about 0.75 to about 2 times the length of the flexible sheet material 12, and most specifically between from about 0.75 to about 1.5 times the length of the flexible sheet material 12.

In some embodiments of the present invention, the cord 14 may extend beyond the flexible sheet material 12 such that the user may easily grasp the cord 14 and manipulate the flexible sheet material 12 into a gathered configuration. The length of the cord 14 extending beyond the flexible sheet material 12 may be at least ½ inch, more specifically between from about ½ inch to about 9 inches, more specifically between from about ½ inch to about 6 inches, more specifically between from about ¾ inch to about 6 inches, more specifically between from about ¾ inch to about 4 inches, more specifically between from about 1 inch to about 3 inches, more specifically between from about 1 inch to about 2 inches, and most specifically between from about 1 inch to about 1½ inch. In some embodiments, the length of the cord 14 extending beyond the flexible sheet material 12 may range between from about 24 inches to about 3 inches, more specifically between from about 21 inches to about 6 inches, more specifically between from about 18 inches to about 6 inches, more specifically between from about 18 inches to about 9 inches, most specifically about 12 inches.

Figure 9:
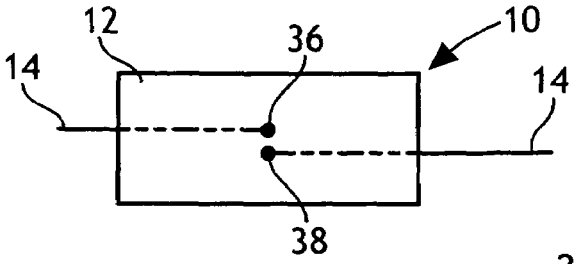
FIG. 9 is another perspective representation of the pourable product of the present invention.

So if the cord 14 is affixed within the length of the flexible sheet material 12 as shown in FIG. 9, the length of the cord 14 may be shorter than the length of the flexible sheet material 12. If the embodiment of the pourable product 10 into which the cord 14 is incorporated has the cord 14 extending out of the flexible sheet material 12 as shown in FIGS. 1, 1*a,* and 2, for example, the length of the cord 14 may be longer than the length of the flexible sheet material 12.

The cord 14 may or may not frictionally engage the flexible sheet material 12. According to the embodiments of the present invention wherein the cord 14 engages the flexible sheet material 12 in a slidable frictional manner, the cord 14 may or may not require the cord 14 to be knotted, knobbed, notched, or otherwise secured by any fastener or other means known in the art. The cord 14 may also be secured simply by the user holding the cord 14 and flexible sheet material 12 in position during use.

The flexible sheet material 12 may be gathered tightly around or about the cord 14 to provide a pouf product 15. In one embodiment of the present invention, the flexible sheet material 12 is tightly gathered in the middle of the length of the cord 14 to provide the pouf product 15. The ends of the cord 14 may then be brought together and tied or otherwise fastened together. In another embodiment of the present invention, the flexible sheet material 12 may be loosely gathered over a portion of the length of the cord 14 to provide the pouf product 15. The user may simply grasp the cord 14 and simply slide the flexible sheet material 12 along the cord 14 until the desired amount of gathering has been established to provide the pouf product 15.

A cord fastener 36 may be employed in the pourable product 10 of the present invention. The cord fastener 36 may permit a slidable frictional engagement between the cord fastener 36 and the cord 14. Any cord fastener 36 capable of securing threads, cords, ribbons, ropes, and the like may be used with the pourable products 10 of the present invention. The cord fastener 36 may be comprised of metal, plastic, or combination of materials, or other suitable materials. Some examples of such cord fasteners 36 are disclosed in U.S. Pat. Nos. 2,585,781; 2,849,821; 3,922,407; 4,034,443; 4,112,551; 4,585,676; and, 5,946,780. Other examples of such cord fasteners 36 include those used to secure corded structures on coat garments by which the amount of gathering of the coat garment may be adjusted.

While the uses of the pourable products 10 of the present invention discussed herein were focused on bathing or showering type uses, it is contemplated that the pourable product 10 of the present invention may also be used for various uses, including but not limited to cleaning or scrubbing of walls, surfaces, sinks, dishes, food (such as fruits and vegetables), and the like. For example, it would be beneficial to have a pourable product 10 that could be used to clean a piece of fruit or vegetable while traveling that is easily packed and disposed of or repacked. Another example of the present invention would allow the cleaning of floors, walls, cars, siding, windows; the cleaning of a bathroom, including the toilet, shower, sink, and bathtub; scrubbing of dishes, pots, and pans; or, the cleaning of a kitchen counter and sink after the processing of food products, such as meats, to remove any germs or other contamination as well as the cleaning or disposability of the pourable product 10, thereby eliminating concerns about sanitization of the pourable product 10 to avoid recontamination of the any surface during future uses of the pourable product 10 and disposal of the pourable product 10.

Another embodiment of the present invention is a method of using the pourable product 10. The flexible sheet material 12 of a pourable product 10 is provided to the user in a flat configuration. The flexible sheet material 12 includes at least one side edge 16. In some embodiments, the flexible sheet material 12 includes opposing side edges 16 and 18 and opposing end edges 20 and 22. The pourable product 10 also includes at least one cord 14 which is interlaced through the flexible sheet material 12 at least two points such that the flexible sheet material 12 is capable of bunching on or about the cord 14 to provide a pouf product 15.

The user engages the cord 14 such that the flexible sheet material 12 is caused to bunch on or about the cord 14 to provide a pouf product 15. The cord 14 may or may not be slidable frictionally engage the flexible sheet material 12. The cord 14 is secured so that the flexible sheet material 12 is maintained in a bunched or gathered configuration on or about the cord 14. The cord 14 may be refastenably or non-refastenably secured. The cord 14 may be secured by simply knotting the cord 14 upon itself. In other embodiments, a cord fastener 36 may be utilized as discussed above.

In one embodiment of the present invention, the cord 14 may be fastened to the packaging in which the pourable product 10 is provided to consumers such that the packaging may serve to activate the bunching of the flexible sheet material 12. In other embodiments of the present invention, the cord 14 and/or the flexible sheet material 12 may be attached to the packaging such that as the pourable product 10 is pulled or otherwise removed from the packaging, the flexible sheet material 12 bunches on or about the cord 14.

In other embodiments of the present invention, the cord 14 and/or the flexible sheet material 12 of one pourable product 10 may be affixed to or may be a continuation of the next pourable product 10, such that when one pourable product 10 is pulled from the packaging, at least a portion of the next pourable product 10 is pulled into position for easy removal from the packaging. The cord 14 and/or flexible sheet material 12 may be perforated or otherwise weaken to facilitate separation from the cord 14 and/or flexible sheet material 12 of the next pourable product 10.

Figure 10:
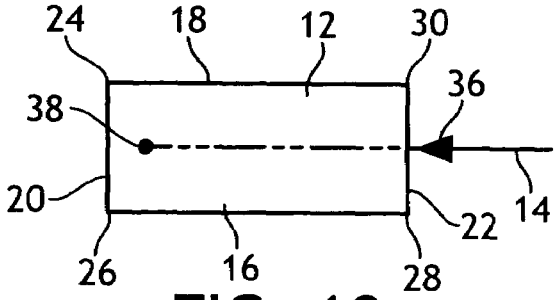
FIG. 10 is another perspective representation of the pourable product of the present invention.
Figure 10A:
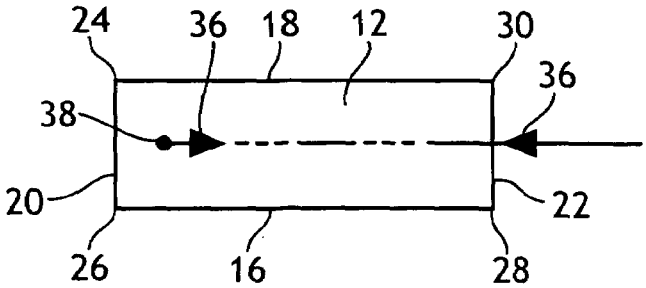
FIG. 10*a* is another perspective representation of the pourable product of the present invention.

According to one embodiment of the present invention, the pourable product 10 comprises one cord 14 affixed to the flexible sheet material 12 adjacent one of the opposing end edges 20 and 22. The cord 14 is interlaced through the flexible sheet material 12 to the other opposing end edge 22 or 20. (See FIG. 10). A cord fastener 36 may be located adjacent the opposing end edge 20 or 22 not adjacent the point where the cord 14 is affixed to the flexible sheet material 12. The flexible sheet material 12 may be bunched on or about the cord 14. The cord fastener 36, if present, may engage the cord 14 to maintain the bunched or gathered configuration of the flexible sheet material 12 to provide a pouf product 15. The cord fastener 36 may comprise 2 or more pieces as shown in FIG. 10*a*. One piece of the cord fastener 36 may be adjacent one of the opposing end edge 20 or 22 and the other piece of the cord fastener 36 may be adjacent the point 38 where the cord 14 is affixed to or otherwise engages the flexible sheet material 12. The cord fastener 36 may be a snap, hook and eye, a male and female threaded structure, or any other interlocking structure. The pieces of the cord fastener 36 may be releasablely interlocking or may be non-releasablely interlocking.

Figure 11:
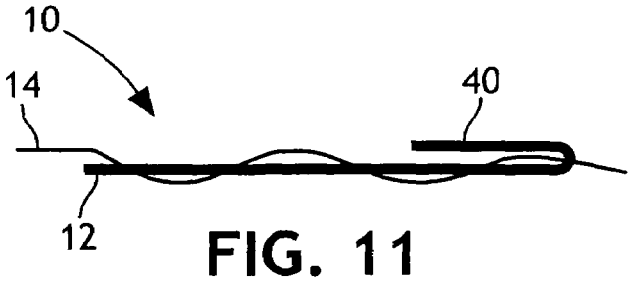
FIG. 11 is another perspective representation of the pourable product of the present invention showing a mitt structure.
Figure 12:
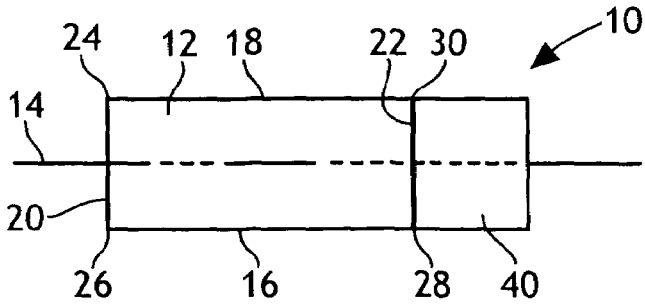
FIG. 12 is a cross sectional view of the pourable product of the present invention showing a mitt structure.

In another embodiment of the present invention, the pourable product 10 includes a mitt structure 40. As shown in FIGS. 11 and 12, one opposing end edge 22 of the flexible sheet material 12 is folded back onto the flexible sheet material 12, thereby forming a mitt structure 40. The folded portion of the flexible sheet material 12 may be affixed to the flexible sheet material 12 at or adjacent the corners 28 and 30, at or adjacent at least a portion of the opposing side edges 16 and 18, or any combination thereof. The cord 14 is interlaced through the flexible sheet material 12. The cord 14 may or may not be interlaced through the flexible sheet material 12 within the folded region. One end of the cord 14 may be affixed to the flexible sheet material 12 or, as shown in FIG.

Figure 13:
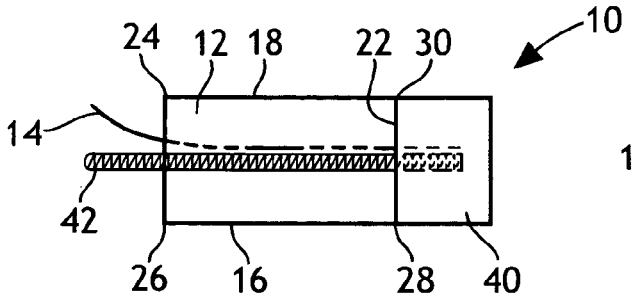
FIG. 13 is another perspective representation of the pourable product of the present invention showing a mitt structure and a handle.

12, simply interlaced through the flexible sheet material 12. The user may place their hand or one or more fingers inside the mitt structure 40 or grasp the mitt structure 40. In the alternative, the mitt structure 40 may receive or otherwise engage a handle 42 as shown in FIG. 13. The handle 42 may or may not be permanently affixed to the flexible sheet material 12. It is understood that the handle 42 may or may not be permanently affixed to the flexible sheet material 12 of the pourable product 10 without or outside of a mitt structure 40. Where the handle 42 is not permanently affixed to the pourable product 10, engaging a mitt structure 40 or not, it permits the reuse of the handle 42 with a new or fresh pourable product 10. Additionally, the handle 42 may be made of or comprise the same material as the flexible sheet material 12. As such, the handle 42 may be flushable, dispersible, biodegradable, or a combination thereof.

Figure 14:
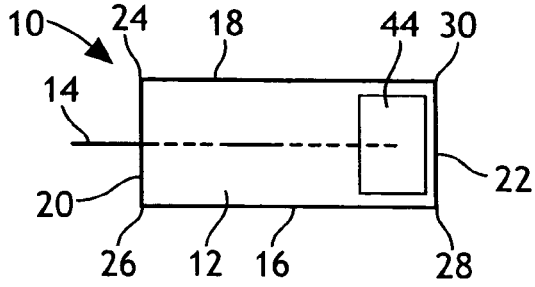
FIG. 14 is another perspective representation of the pourable product of the present invention showing a mitt structure.
Figure 15:
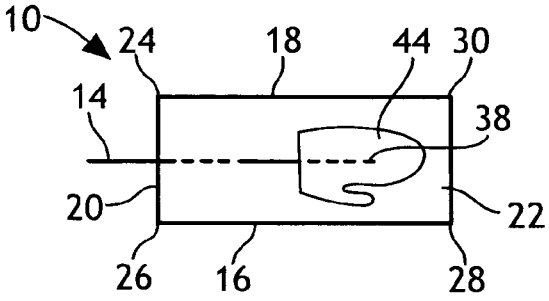
FIG. 15 is another perspective representation of the pourable product of the present invention showing a mitt structure.
Figure 16:
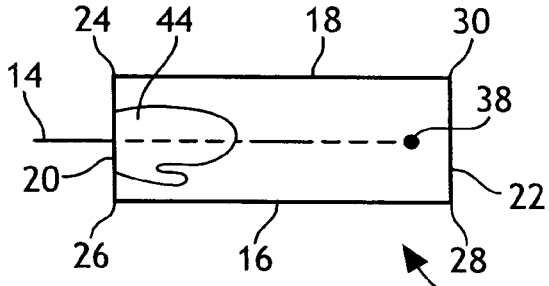
FIG. 16 is another perspective representation of the pourable product of the present invention showing a mitt structure.

Alternatively, a separate piece of material 44 may be attached to the flexible sheet material 12 as shown in FIGS. 14 and 15. The piece of material 44 may be placed adjacent at least one of the opposing end edges 20 and 22 or one of the opposing side edges 16 and 18 of the flexible sheet material 12, or the piece of material 44 may be more centrally positioned on the flexible sheet material 12. It is understood that any material suitable for use as the flexible sheet material 12 in the pourable product 10 may be utilized for the piece of material 44. The piece of material 44 may be made of or comprise the same material as the flexible sheet material 12 or may be made of or comprised of a different material than the flexible sheet material 12. The material 44 may function as a handle or may be configured to function as a mitt structure to receive a hand or handle 42. The piece of material 44 could be impermeable to protect the user's hand from the chemicals or fluids encountered during use. The cord 14 may be affixed to or otherwise engaged with the pourable product 10 at point 38 adjacent the piece of material 44. One example where such a configured pourable product 10 would be desired is using the pourable product 10 for cleaning a counter or toilet bowl. The piece of material 44 may or may not be permanently affixed to the pourable product 10. The size of the piece of material 44 may be less than, equal to, or greater than the size of the flexible sheet material 12 of the pourable product 10. Typically, the piece of material 44 will be the same size or less than the size of the flexible sheet material 12, and most typically, the size of the piece of material 44 will be less than the size of the flexible sheet material 12.

In another embodiment of the present invention, a separate piece of material 44 may be attached to the flexible sheet material 12 as shown in FIG. 17. The piece of material 44 may be placed adjacent at least one of the opposing end edges 20 and 22 or one of the opposing side edges 16 and 18 of the flexible sheet material 12. The cord 14 may be affixed to or otherwise engaged with the pourable product 10 such that the point 38 is not adjacent the piece of material 44.

Figure 18:
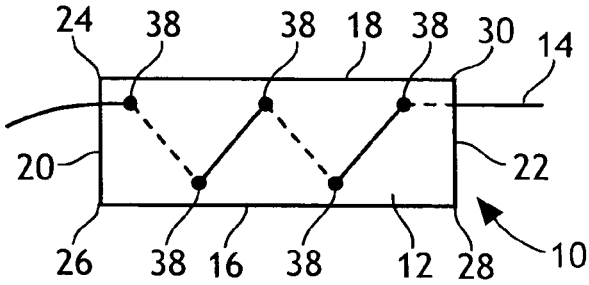
FIG. 18 is another perspective representation of the pourable product of the present invention.
Figure 19:
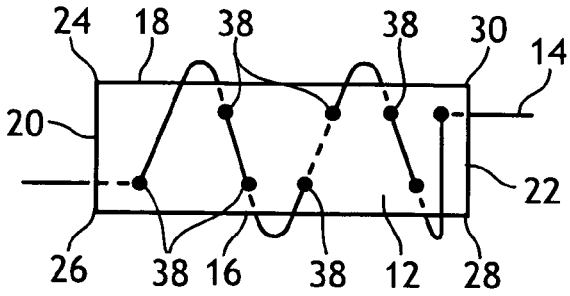
FIG. 19 is another perspective representation of the pourable product of the present invention.
Figure 20:
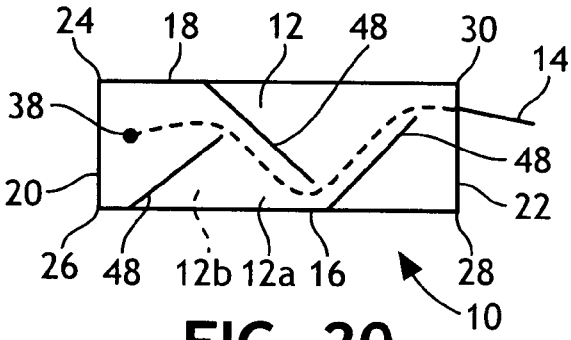
FIG. 20 is another perspective representation of the pourable product of the present invention.

Additional embodiments of the present invention are shown in FIGS. 17, 18, 19, and 20. In FIG. 17, a pourable product 10 is shown that comprises multiple cords 14 (or in the alternative, a single cord 14 engaging the flexible sheet materials at multiple points 38) engaging the flexible sheet material 12 at multiple points 38. The shape of the flexible sheet material 12 may be any shape desired to benefit the pourable product 10 or manufacturing processes. The multiple cords 14 may be twisted, tied, or otherwise engaged with each other as shown by element 46. In other embodiments, the cords 14 may be left as individual elements or as groups of portions of the cords 14. FIG. 18 shows a single cord 14 engaging the flexible sheet material 12 at multiple points 38. FIG. 19 also shows a single cord 14 engaging the flexible sheet material 12 at multiple points 38. However, FIG. 19 shows an embodiment wherein the flexible sheet material 12 is caused to twist as well as bunch on or about the cord 14. FIG. 20 shows a multiply pourable product 10. The plies 12*a* and 12*b* may be attached to each other along the lines 48. The lines 48 may be of different shapes and sizes from each other. The attachment along the lines 48 may be refastenable or nonrefastenable. The cord 14 is positioned between the plies 12*a* and 12*b* and threaded around the lines 48. The lines 48 may be created by adhesives, sewing, thermal or ultrasonic bonding, hook and loop, hook and eye, snaps, buttons, or any other means known in the art. The cord 14 may be affixed or otherwise engaged with one or both of the plies 12*a* and 12*b* of the flexible sheet material 12 as shown at point 38. It is understood that additional plies 12*c*, ect. may be incorporated into the pourable product 10.

Figure 20A:
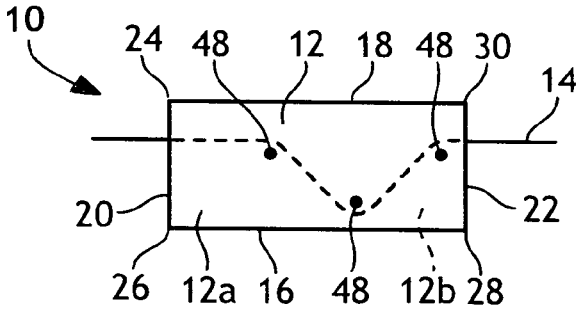
FIG. 20*a* is another perspective representation of the pourable product of the present invention.

FIG. 20*a* shows another embodiment of the lines 48 in the pourable product 10.

Figure 21:
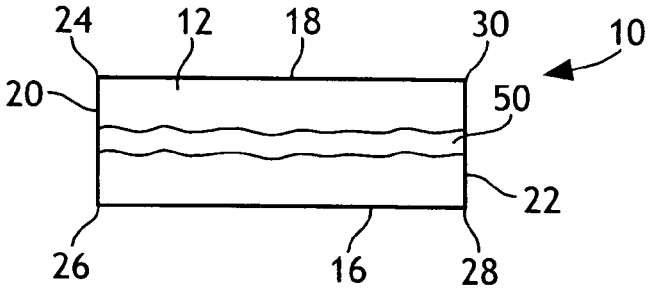
FIG. 21 is another perspective representation of the pourable product of the present invention.

In other embodiments of the present invention, the cord 14 and/or the flexible sheet material 12 may be replaced with a fluid activated or heat activated shrinkable material that caused the flexible sheet material 12 to bunch on or about itself. FIG. 21 shows such an embodiment of the present invention where in the cord 14 has been replaced with shrinkable material. The shrinkable material is shown as element 50. When activated, the shrinkable material 50 will shrink, causing the flexible sheet material 12 to bunch or gather. It is understood that the shrinkable material represented as element 50 may take any shape within the pourable product 10. In addition, the shrinkable material 50 may comprise from about 0.1 to about 100 percent of the pourable product 10; more specifically, from about 5 to about 100 percent; more specifically from about 10 to about 90 percent; more specifically from about 10 to about 80 percent; more specifically from about 20 to about 80 percent; more specifically from about 20 to about 70 percent; more specifically from about 30 to about 70 percent; more specifically from about 30 to about 60 percent; and, most specifically from about 40 to about 60 percent. In another embodiment of the present invention, the flexible sheet material 12 comprises a shrinkable material 50 such that upon activation, the flexible sheet material 12 bunches on or about itself.

The shrinkable material 50 may be comprised of any material or materials that would be compatible with the water, soaps, chemicals, substances, and matter that the pourable product 10, or pouf product 15, would encounter during use. The shrinkable material 50 may be absorbent or non-absorbent. The shrinkable material 50 may be elastic, nonelastic, or a combination thereof. The shrinkable material 50 may be hydrophobic or hydrophilic. The shrinkable material 50 may be prepared having at least one aperture for receiving a cord 14. The shrinkable material 50 may have a smooth texture or a three dimensional texture.

The shrinkable material 50 may be comprised of dispersible, compostible, heat activated, and/or fluid activated shrinkable material that causes the flexible sheet material 12 to bunch on or about itself once the shrinkable material has been activated. Some examples of such materials are disclosed in U.S. Pat. Nos. 6,423,883 B1; 6,383,161 B1; 5,509,913; 4,834,733; 5,916,969; 5,738,646; and, 5,397,625. The shrinkable material 50 may be comprised of a natural material, a synthetic material, or a combination of natural and synthetic materials. The shrinkable material 50 may comprise cotton, linen, wool, nylon, polyester, spandex, cellulosic materials, rayon, polyethylene, polypropylene, polyethyleneterphthalate, acrylic acids, polylactides, polyacrylamides, polypropylene oxides, polyethylene oxides, polyvinyl alcohols, polyvinyl oxides, polyvinyl pyrolidones, polyacrylates, polypeptides, polysaccharides, polyvinyl acetates, ethylene vinyl acetates, or combinations or blends of any of these materials. It is understood that the terms "combination" or "combinations" as used herein includes combination(s) and/or blend(s).

The width of the shrinkable material 50 for use in the pourable product 10 of the present invention ranges between from about 0.1 inch to about 10 inches, more specifically between from about 0.1 inch to about 9 inches, more specifically between from about 0.1 inch to about 8 inches, more specifically between from about 0.1 inch to about 7 inches, more specifically between from about 0.1 inch to about 6 inches, more specifically between from about 0.2 inch to about 6 inches, more specifically between from about 0.2 inch to about 5 inches, more specifically between from about 0.2 inch to about 4 inches, more specifically between from about 0.2 inch to about 3 inches, more specifically between from about 0.2 inch to about 2 inches, and most specifically between from about 0.2 inch to about 0.1 inch. In some embodiments, the width of the shrinkable material 50 may range between about 0.1 to about 1 inch, more specifically between from about 0.2 inch to about 0.5 inch, and most specifically between from about 0.3 inch to about 0.4 inch.

The overall length of the shrinkable material 50 may vary depending on the embodiment of the pourable product 10 into which the shrinkable material 50 is incorporated. In some embodiments of the present invention, the shrinkable material 50 may be the length of the flexible sheet material 12 while the flexible sheet material 12 is in a flat configuration. In other embodiments of the present invention, the shrinkable material 50 may be shorter than the length of the flexible sheet material 12 in a flat configuration.

In some embodiments of the present invention, the length of the shrinkable material 50 may range from between about 0.1 to about the length of the flexible sheet material 12, more specifically between from about 0.2 to about the length of the flexible sheet material 12, and most specifically between from about 0.5 to about the length of the flexible sheet material 12. In other embodiments, the shrinkable material 50 may range from between about 0.1 to about the length of the flexible sheet material 12, more specifically between from about 0.2 to about 0.9 the length of the flexible sheet material 12, more specifically between from about 0.2 to about 0.8 the length of the flexible sheet material 12, more specifically between from about 0.3 to about 0.8 the length of the flexible sheet material 12, more specifically between from about 0.3 to about 0.7 the length of the flexible sheet material 12, more specifically between from about 0.4 to about 0.7 the length of the flexible sheet material 12, more specifically between from about 0.4 to about 0.6 the length of the flexible sheet material 12, and most specifically about 0.5 the length of the flexible sheet material 12.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

The invention claimed is:

1. A poufable product comprising:

at least one flat ply of flexible sheet material having at least one side edge;

at least one cord;

wherein the cord is interlaced with the flat ply of flexible sheet material and wherein the poufable product further includes packaging; the cord is fastened to the packaging such that the packaging activates bunching on or about the cord.

2. The poufable product of claim 1, wherein the ply of flexible sheet material has a tubular structure.

3. The poufable product of claim 1, wherein the flat ply of flexible sheet material comprises at least two layers.

4. The poufable product of claim 1, wherein one of the layers has a different characteristic or property than the other layer(s).

5. The poufable product of claim 1, wherein there are two or more plies of flexible sheet material.

6. The poufable product of claim 1, wherein a filament size of the flat ply of flexible sheet material is between about 0.1 denier and about 10 denier.

7. The poufable product of claim 1, wherein the flat ply of flexible sheet material has a length of about 6 feet or less.

8. The poufable product of claim 1, wherein the cord has a width between about 0.01 inch and about 1 inch.

9. The poufable product of claim 1, wherein the flat ply of flexible sheet material forms a mitt structure.

10. The poufable product of claim 1, further comprising a handle.

11. The poufable product of claim 1, wherein the flat ply of flexible sheet material is dispersible, flushable, biodegradable, or a combination thereof.

12. The poufable product of claim 1, wherein the flat ply of flexible sheet material is breathable.

13. The poufable product of claim 1, wherein the flat ply of flexible sheet material is impermeable.

14. The poufable product of claim 1, wherein the flat ply of flexible material comprises a shrinkable material.

15. The poufable product of claim 1, wherein the cord includes a shrinkable material.

* * * * *